United States Patent [19]

Valenzuela

[11] Patent Number: 4,854,778

[45] Date of Patent: Aug. 8, 1989

[54] CAISSON TOWER PLATFORM AND METHOD OF SETTING SAME

[75] Inventor: Ernesto D. Valenzuela, Houston, Tex.

[73] Assignee: Cameron Iron Works USA, Inc., Houston, Tex.

[21] Appl. No.: 93,303

[22] Filed: Sep. 4, 1987

[51] Int. Cl.[4] ..... E02B 17/00

[52] U.S. Cl. ..... 405/204; 405/203; 405/195; 175/7

[58] Field of Search ..... 405/203, 204, 196, 198, 405/208, 195; 175/5, 7

[56] References Cited

U.S. PATENT DOCUMENTS

| | | | |
|---|---|---|---|
| 3,001,595 | 9/1961 | Lucas | 405/203 X |
| 3,482,408 | 12/1969 | Manning . | |
| 3,516,259 | 6/1970 | Tokola | 405/208 |
| 3,572,044 | 3/1971 | Pogonowski . | |
| 4,087,983 | 5/1978 | Wood . | |
| 4,222,682 | 9/1980 | Vilain | 405/203 |
| 4,269,542 | 5/1981 | Mueller | 405/196 |
| 4,558,973 | 12/1985 | Blandford | 405/216 |
| 4,679,964 | 7/1987 | Blandford | 405/227 X |
| 4,687,380 | 8/1987 | Meek et al. | 405/204 |
| 4,728,224 | 3/1988 | Salama et al. | 405/195 |
| 4,740,107 | 4/1988 | Casbarian et al. | 405/204 X |

*Primary Examiner*—Dennis L. Taylor

[57] ABSTRACT

The present invention relates to an improved caisson structure which is adapted to support a production platform above the water and has its base on bottom and has a foot print or base which will pass through the drilling slot of a jackup rig. The caisson structure includes a large diameter caisson supported in a base structure including at least three base columns through which piling is placed and bracing extending between the columns and the caisson, a platform supported at the upper end of the caisson with production tubing and its casing extending upward through the caisson, and where desired, filled with concrete surrounding the casing within the caisson. The improved caisson structure can be used to surround and support an existing conductor pipe extending from a subsea wellhead to the surface or to surround a wellhead at the surface and the conductor which extends to such wellhead from a subsea well bore. The improved method of setting the caisson structure includes lifting the structure from a barge and lowering to position its base in engagement with the sea bottom in the desired location, piling is placed in and set through the corner columns, the wells are drilled through the caisson, the production strings are set and the wellhead production equipment are installed on the productions strings at the platform. The piling is steel tubular members which can be cut below the sea bottom to recover the caisson structure after the wells are plugged. The caisson structure after retrieval can be reused in a different location merely by adapting its length to be suitable for the water depth in the new location.

15 Claims, 8 Drawing Sheets

CAISSON TOWER PLATFORM AND METHOD OF SETTING SAME

BACKGROUND

The present invention relates to an offshore structure for supporting a production platform above the water for subsea walls, particularly for shallow wells which can be drilled by jackup rig.

U.S. Pat. No. 4,087,983 discloses an offshore platform which extends from the subsea location and includes a plurality of knuckle joints which are arranged circumferentially and includes a very large base footprint and has braces extending from the outer portions of the base to the central tubular member.

U.S. Pat. No. 3,572,044 discloses an offshore platform which is lowered from a floating rig and after the base is set which includes angular piling under the corner leg guides of the base and around the exterior of the wellhead unit. This structure has a very large footprint and is used only for setting the wellhead unit and then recovered.

U.S. Pat. No. 3,482,408 discloses a telescoping caisson which connects from a subsea location to a production deck above the surface of the water and is held in location by a series of guy wires.

U.S. Pat. No. 4,222,682 discloses a sea bottom structure for supporting a platform above the water surface and includes a large base including floatation tanks to support the column connecting between the platform and the base during transportation.

U.S. Pat. No. 4,558,973 discloses a structure for clamping about a subsea well conductor pipe to support it is an erect position and such structure includes a wide spread base with half shells secured to the base, extending upwardly, is clamped around the conductor pipe and angular supports extending angularly from the corners of the base to the half shells near their upper ends to support them in their erect position.

SUMMARY

The present invention relates to an improved caisson structure which is adapted to support a production platform above the water and has its base on bottom and has a foot print or base which will pass through the drilling slot of a jackup rig. The caisson structure includes a large diameter caisson supported by a truss structure including at least three base columns through which piling is placed and bracing extending between the columns and the caisson, a platform supported at the upper end of the caisson with production tubing and its casing extending upward through the caisson, and where desired, the caisson is filled with concrete surrounding the casing within the caisson. The improved caisson structure can be used to surround and support an existing conductor pipe extending from a subsea wellhead to the surface. The improved method of setting the caisson structure includes lifting the structure from a barge and lowering to position its base in engagement with the sea bottom in the desired location, piling is placed in the corner columns, the wells are drilled through the caisson, the production strings are set and the wellhead production equipment are installed on the productions strings at the platform. The piling is steel tubular members which can be cut below the sea bottom to recover the caisson structure after the wells are plugged. The caisson structure which is then easily recovered is reusable for other wells in different depths of water.

An object of the present invention is to provide an improved caisson structure for a subsea well which has a footprint smaller than the slot of the jackup rig which is used to set the structure.

Another object is to provide an improved caisson structure for several subsea wells in which the structure has a foot print smaller than the slot in the jackup ring which is used to set the structure.

Another object is to provide an improved caisson structure having a base which is small enough to be set by a jackup rig without the rig having to move for the drilling or setting of the piling.

A further object is to provide an improved caisson structure for subsea petroleum wells which is vertically stable and relatively inexpensive compared to prior art platform.

Still another object is to provide an improved method of setting a caisson platform structure on a subsea well location.

A still further object is to provide an improved caisson structure which can be retrieved, adapted and reused in another location in water of a different depth.

BRIEF DESCRIPTION OF THE DRAWINGS

These and other advantages of the present invention are hereinafter set forth and explained with reference to the drawings wherein.

DESCRIPTION OF THE PREFERRED EMBODIMENTS

Figure 1:
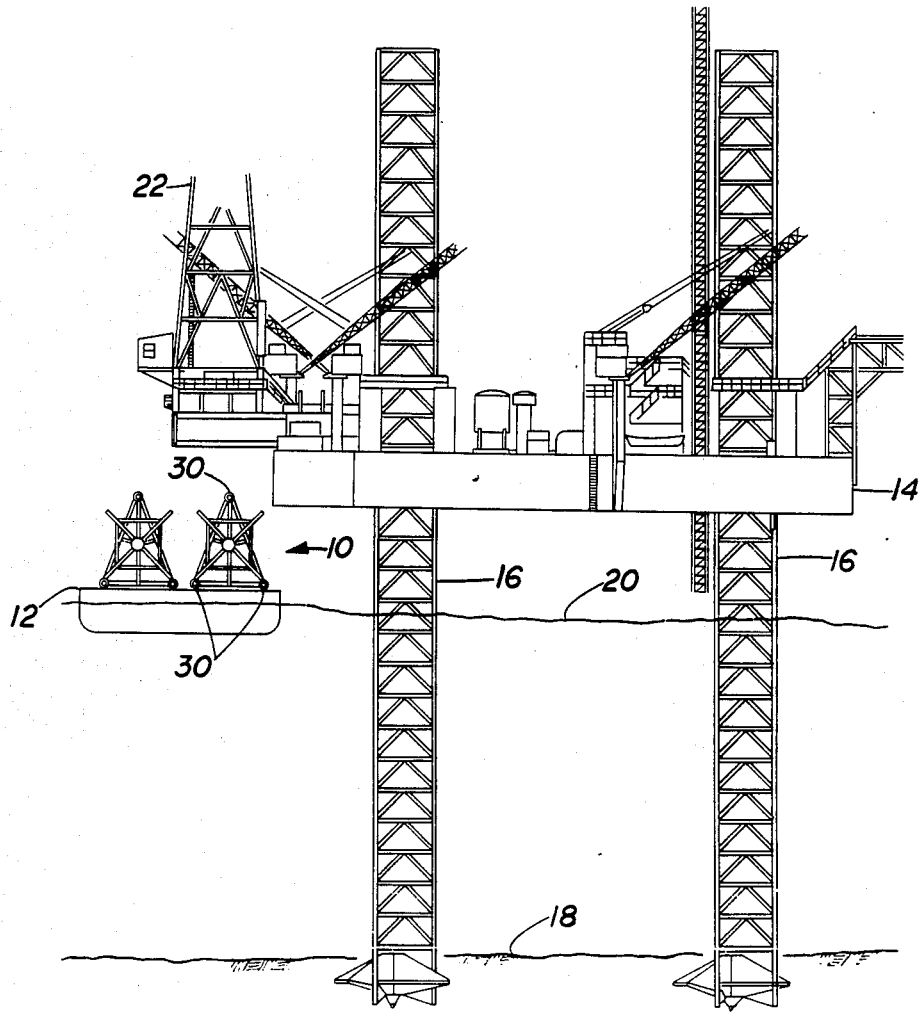
FIG. 1 is a schematic view of a subsea location with a jackup rig located thereabove and a barge on which the improved caisson structure is positioned.

When improved caisson structure 10 of the present invention is to be used it is carried to the subsea well location on barge 12 and jackup rig 14 is positioned over the desired subsea well location and is jacked up on its legs 16 which have their lower ends in engagement with the bottom 18 of the water 20. In FIG. 1, barge 12 with caisson structure 10 positioned thereon has been moved under the drilling slot so that the travelling block of derrick 22 can be connected thereto and lift caisson structure free of barge 12. Barge 12 has been moved under rig 14 and travelling block of derrick 22 connected to caisson structure 10. By use of the jacks on its legs 16, rig 14 is elevated to raise structure 10 from barge 12.

Figure 2:
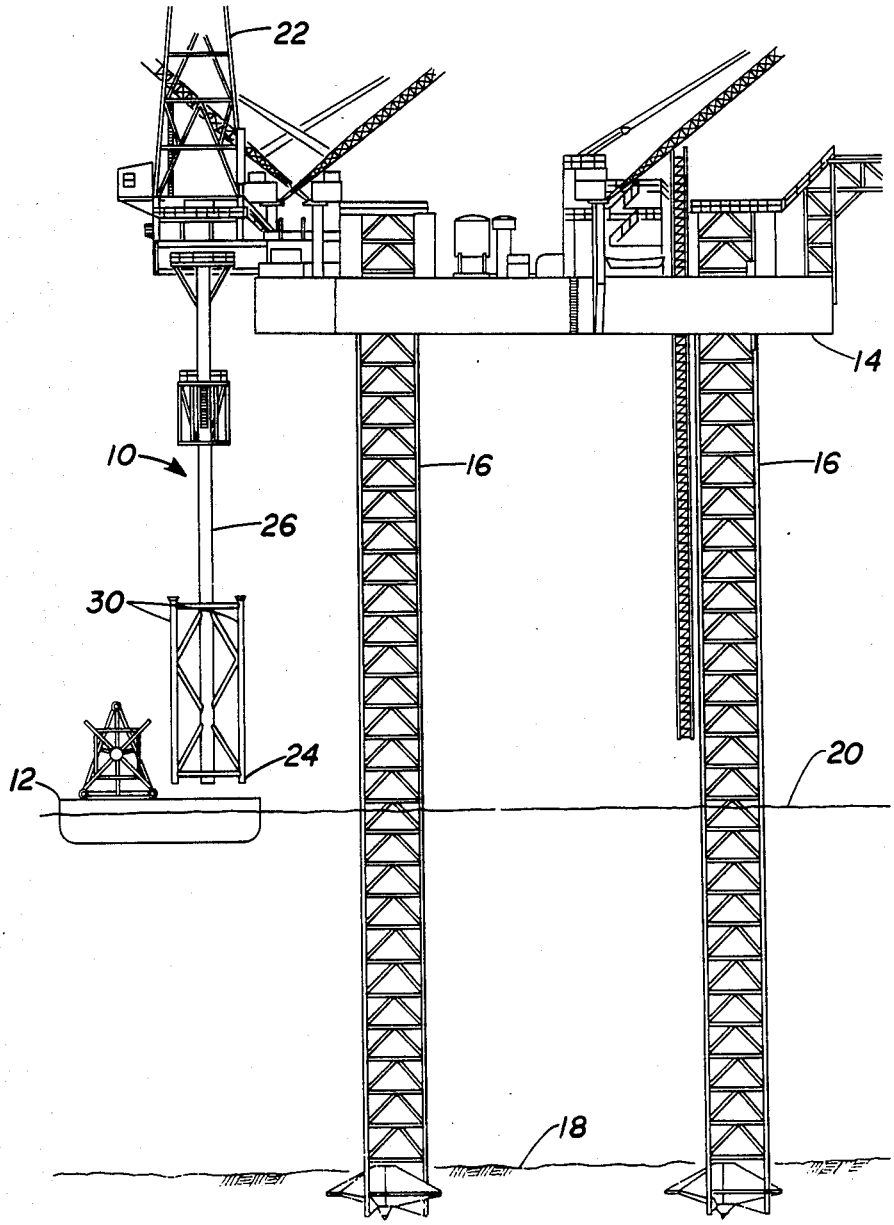
FIG. 2 is a similar schematic view of the jackup rig picking up the caisson structure from the barge.
Figure 3:
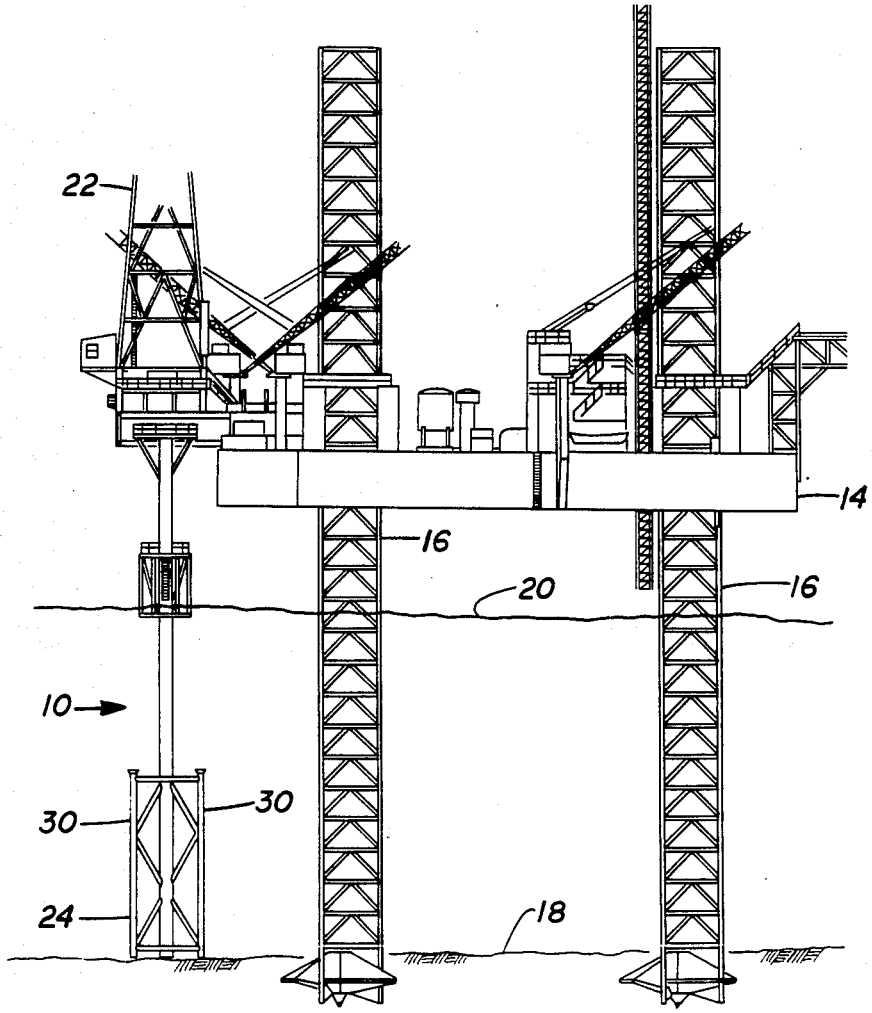
FIG. 3 is another similar view of the jackup ring lowering the caisson structure to the sea bottom.

Caisson structure 10 when lifted above barge 12 as best shown in FIG. 2 is in position to be lowered directly downward in water until its truss base 24 is positioned on the bottom 18 with its central caisson 26 positioned over the preselected location of the well bore to be drilled therethrough by rig 14. The lowering of caisson structure 10 is done either by lowering travelling block of derrick 22 or by lowering rig 14 on its legs 16 or by a combination of both so that rig 14 is lowered to its preferred drilling position and any further lowering of caisson structure 10 is accomplished by the travelling block. FIG. 3 illustrates the position of caisson structure 10 on bottom 18.

Figure 4:
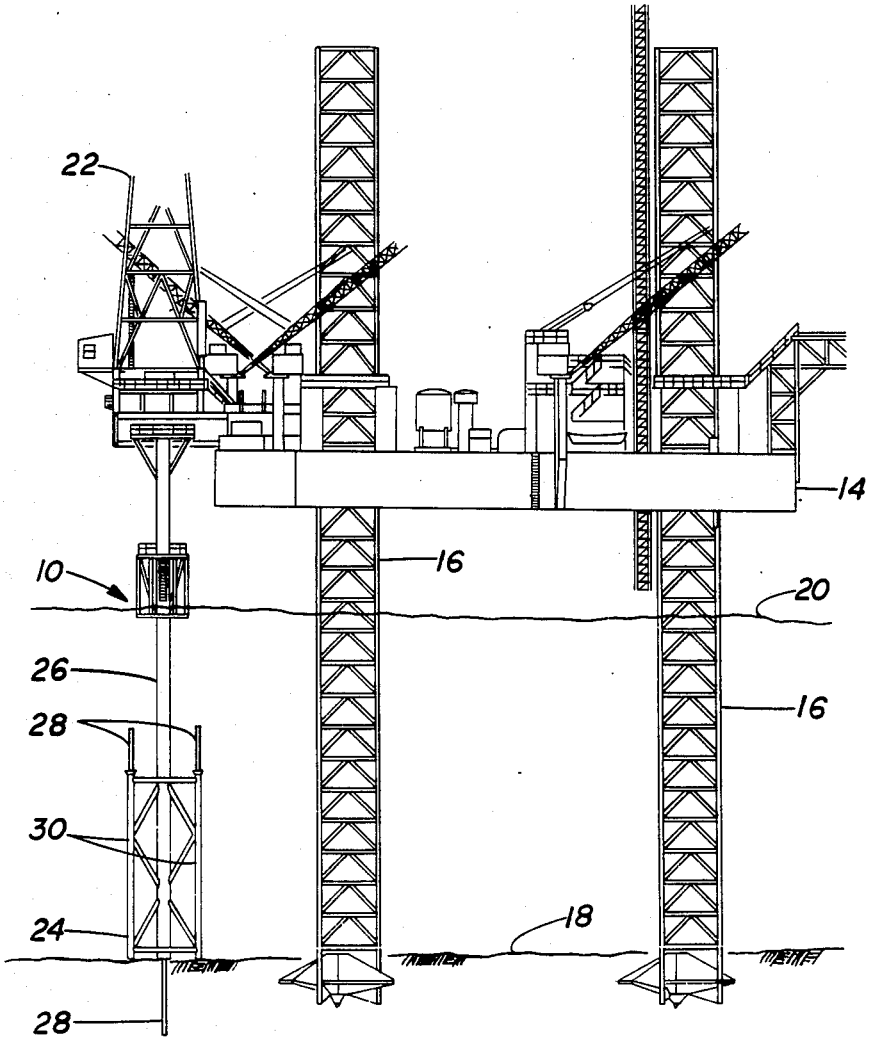
FIG. 4 is another similar view of the setting of the piles in the base of the caisson structure.

With caisson structure 10 on bottom 18, piles 28, which consist of two stage steel piles are installed through the corner upright tubular members or skirt legs 30 of truss base 24. The first stage pile is driven or allowed to sink to a shallower depth and is used as a conductor for a second insert pile which is drilled and installed by rig 14 to the desired depth;. As shown in FIG. 4, one of two stage piles 28 have been installed through skirt tubular member 30 which is hidden by central caisson 26 and the other two first stage piles are positioned in the other two skirt tubular members 30 awaiting to be driveen into sea bottom 18. After the three two stage piles 28 have been installed, the caisson structure 10 is secured in its position on bottom 18. At this stage production deck 40 is installed on top of caisson structure 10 and secured in place as by welding.

Figure 5:
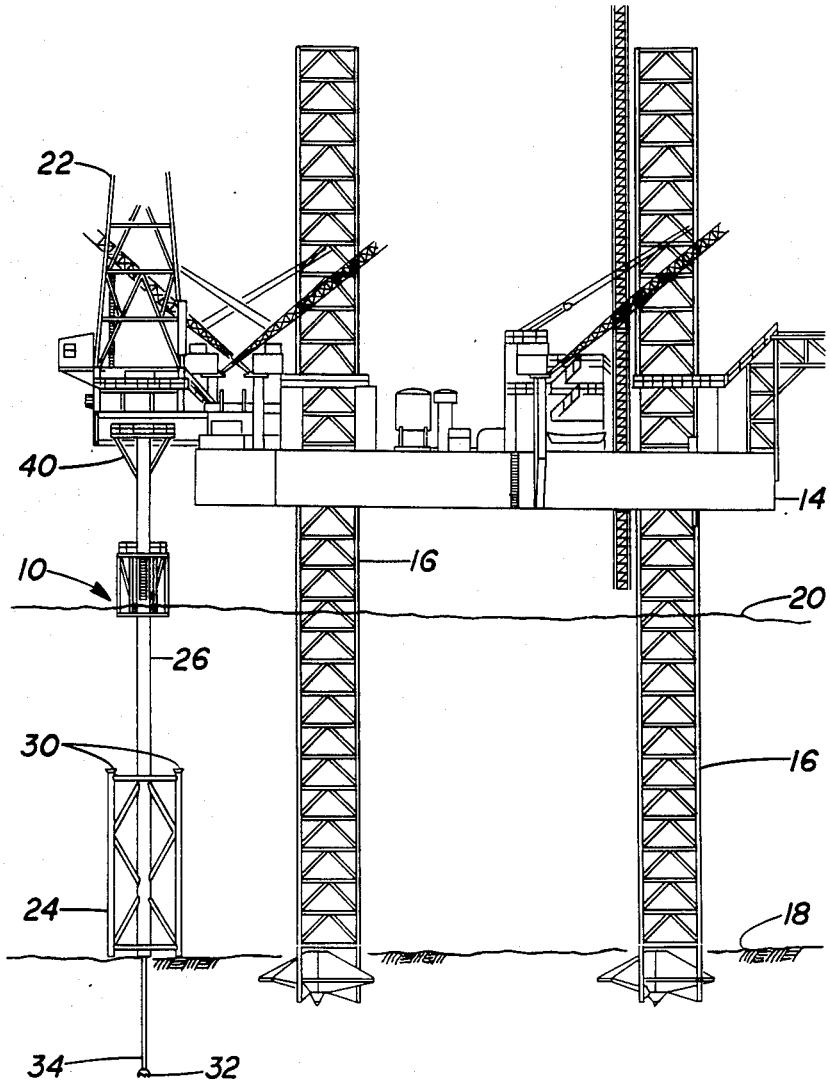
FIG. 5 is another similar view of the drilling of wells through the caisson structure.
Figure 6:
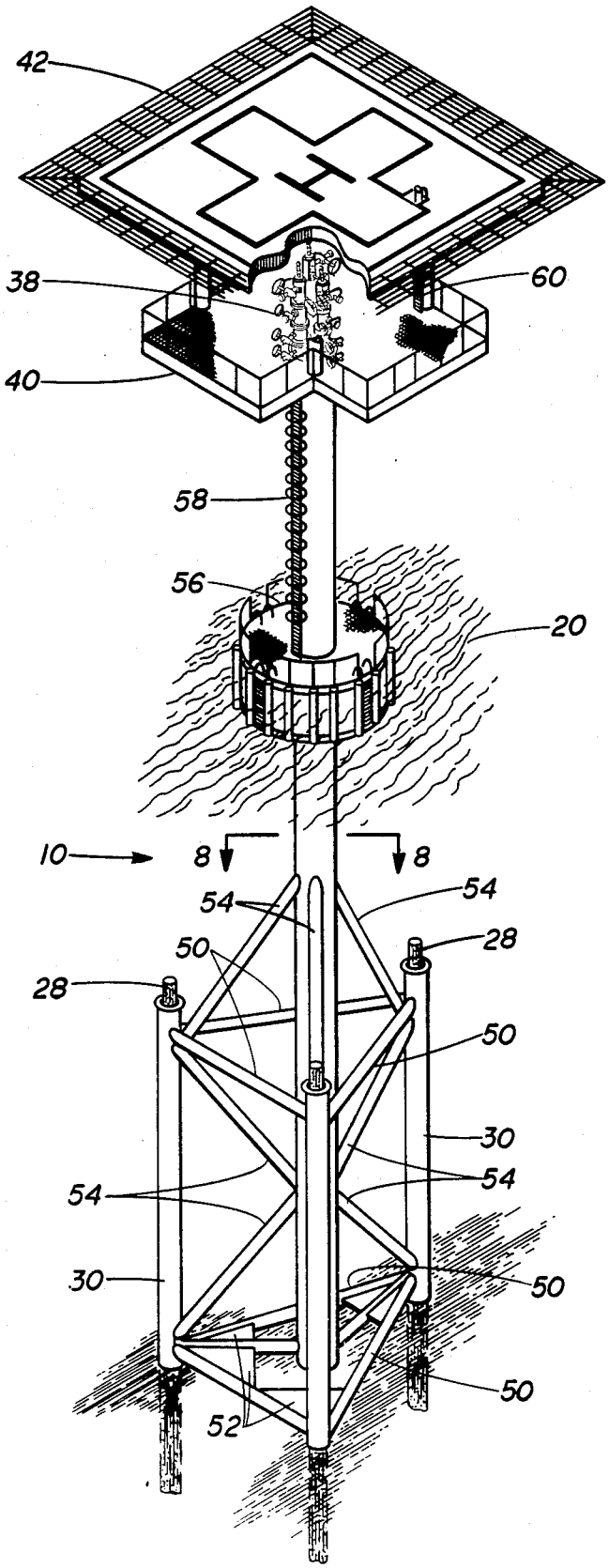
FIG. 6 is an isometric view of the production of wells through the caisson structure to the production equipment on the caisson structure platform.

FIG. 5 illustrates the next step in the sequence of installation steps for placing caisson structure 10 in use. With caisson structure 10 secured by piles 28, drill string 32 is used to drill one or more well bores 34 beneath the central caisson 26 into the producing formations. With well bores 34 completed, production strings 36 extend from the producing formation (not shown) to production equipment 38 on the platform 40 located above the surface of the water 20 at the top of caisson structure 10, as shown in FIG. 6. Additionally, if desired, helicopter pad 42 may be provided above production platform 40.

Figure 7:
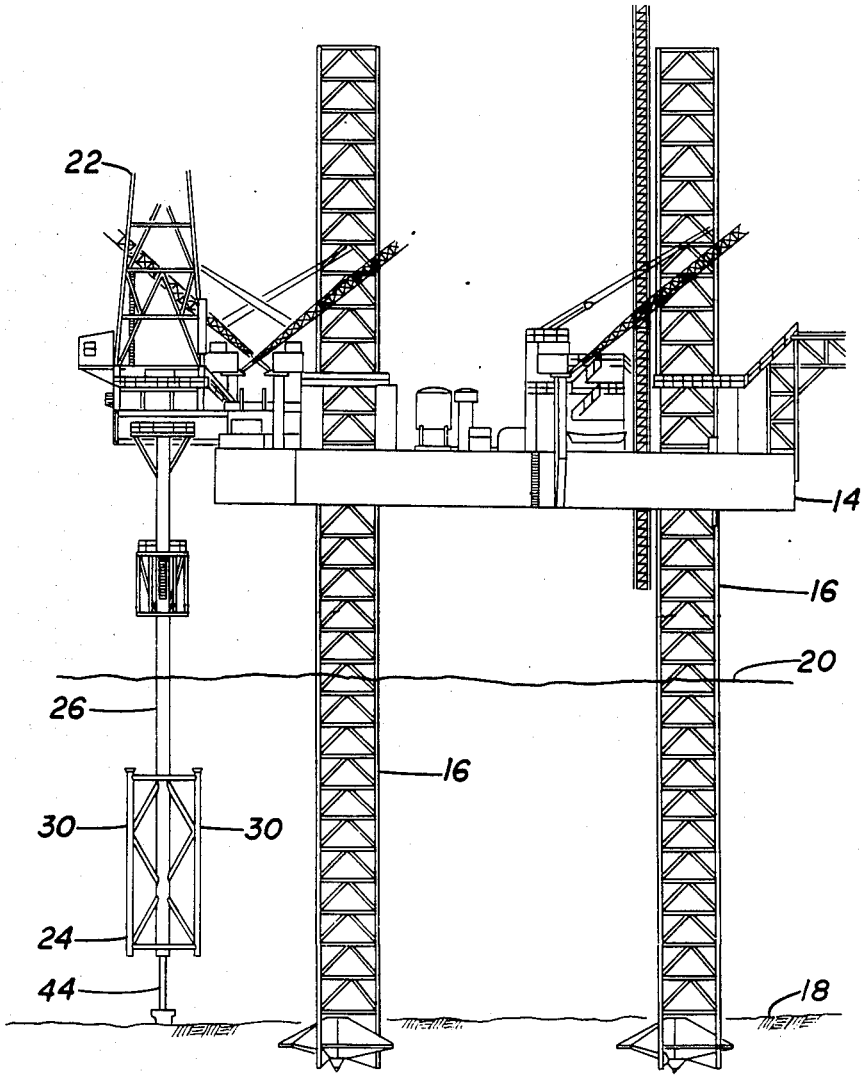
FIG. 7 is another schematic view of the positioning of an improved caisson structure into surrounding and supporting relationship to a conductor pipe on an existing subsea well.

In addition to the use of improved caisson structure 10 of the present invention as previously described, structure 10 can be installed over existing subsea production strings 44 which extend from a subsea wellhead to the water surface as shown in FIG. 7 or over a surface wellhead of a subsea well substantially as described previously herein except that caisson structure 10 is positioned with the upper end of strings 44 within central caisson 26 and it lowered to the sea bottom 18 with strings 44 extending through central caisson 26.

Figure 8:
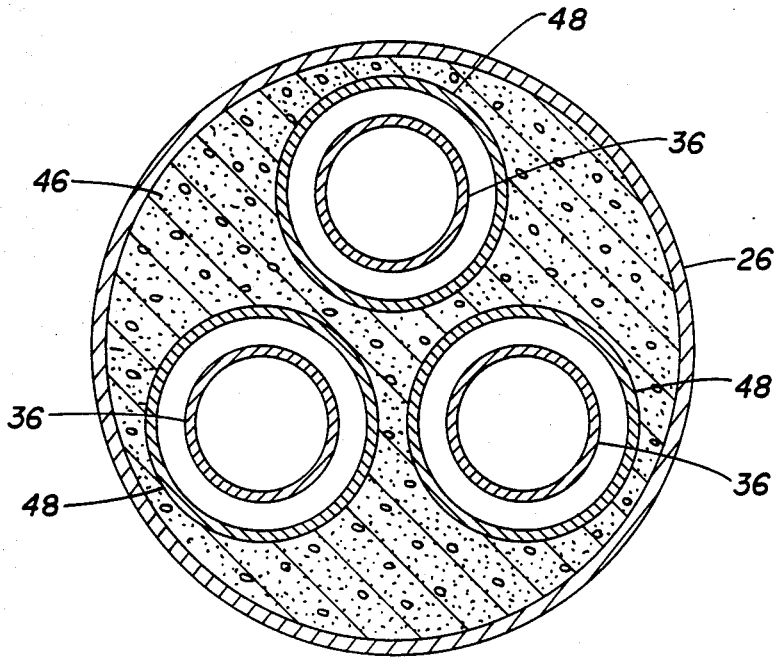
FIG. 8 is a sectional view taken along lines 8—8 in FIG. 6 to illustrate the strings extending through the caisson and the distribution of cement within the caisson and around the strings.

In many cases it is desirable to provide some additional stiffening to central caisson 26, particularly in deeper water depths in which central caisson 26 is made out of composite material to provide more strength and is joined together in a suitable manner to the steel truss base 24. Such composite tubular members have greater strength characteristics than the metal tubular members so that both types may be provided with the stiffening of the cement described above. The additional stiffness is provided, as shown in FIG. 8, by the filling of the interior of central caisson 26 with cement 46 in surrounding relationship to casing strings 48 which surround production tubing 36. The cement 46 acts to tie strings 48 to central caisson 26 and add to its stiffness so that the cemented structure acts as a unit rather than only caisson 26 carrying all of the loading. For severe weather conditions and deeper water depths, the strength of the central caisson 26 can be increased even more by adding a buoyancy tank which will decrease the unsupported length of the caisson and therefore increase its buckling strength.

Caisson structure 10 includes central caisson 26, base 24, production platform 40 and piles 28 as shown in FIG. 6. Central caisson 26 is a tubular member which in case of shallow wells may be entirely of steel or in deeper water depths may be composite material such a filament wound tubular structures with suitable joints. Such structures using filaments of fiberglass or of a carbon material such as graphite or other carbon fibers in a suitable matrix are preferred to be used to form such composite structures. The diameter of central caisson 26 is sufficient for its desired stiffness and to accommodate the number of production strings 36 which are to extend through central caisson 26. Base 24 includes tubular members 30, preferably three in number and arranged in triangular relationship with suitable horizontal braces 50 extending between adjacent tubular members 30 and between tubular members 30 and central caisson 26 near the upper and lower ends of tubular members 30. Mud mat brackets 52 are provided between the lower braces 50 adjacent tubular members 30 as shown to provide a larger surface for engagement with bottom 18. Angular braces 54 extend from the junction of braces 50 with tubular members 30 angularly to a position on central caisson 26. The height of base 24 is determined by the height of caisson structure 10 and the loading which it is to support, both axial loading from weight of production equipment and side loading from current, tides, waves and surface winds. Boat landing platform 56 is secured around central caisson 26 at a position to allow the landing and docking of watercraft on the water surface. Additionally as previously mentioned, helicopter pad 42 may be provided above production equipment 38 on production platform 40. A suitable ladder 58 is provided on the exterior of central caisson 26 from a position immediately above boat landing platform 56 to production platform 40. When helicopter pad 42 is included access is provided between pad 42 and production platform 40 by ladder 60.

It is suggested that piles 28 be tubular in shape so that if it is desired to retrieve caisson structure 10 following the closing and severing of the wells below the bottom 18, that a suitable cutter can be lowered through each of the legs 30 and the piles 28 and be cut at a position sufficiently below bottom 18 to comply with all regulations regarding closing and abandoning wells while allowing retrieval of caisson structure 10. Such structure 10 can be reused at another location by the addition or removal of sections of the tubular member forming the caisson 26 whether caisson is metal or composite material. This is easily, quickly and simply done.

What is claimed is:

1. The method of setting a caisson structure for a subsea production well comprising the steps of locating a jackup rig on the water surface in position over a preselected subsea well site with its legs on bottom, delivering a caisson structure to the jackup rig, said caisson structure having a central caisson which is tubular, a base with a plurality of tubular legs spaced around said central caisson, support braces extending between said legs and said central caisson, said central caisson being sufficiently long to extend from the subsea production well on the bottom to a position above the surface of the water and sufficiently large in diameter to allow drilling therethrough and to accommodate a plurality of production strings extending therethrough, picking said caisson structure up with said jackup rig so that it is vertically positioned, lowering said caisson structure to the bottom with its central caisson in surrounding relationship to said preselected subsea well site, setting piles through the tubular legs of said caisson structure, connecting production strings extending through said central caisson to production equipment above the water surface at the upper end of said caisson structure, filling the interior of said central caisson around the exterior of the production strings positioned therein with cement to strengthen the central caisson with the added strength of the production strings.

2. The method according to claim 1 wherein said cement filling step is used to strengthen the central caisson which is made of a composite material.

3. The method according to claim 1 including the step of drilling at least one well through said central caisson prior to said cement filling step.

4. The method according to claim 1 wherein said lowering step includes the step of lowering said caisson structure over an existing production conduit of a subsea well into position so that the lower end of said central caisson surrounds the subsea wellhead on the bottom.

5. A caisson structure for connecting between shallow subsea wells and the surface of the water comprising a central tubular caisson, said central tubular caisson being sufficiently long to extend from the subsea bottom to a position above the water surface, at least one production string extending from the subsea well through said central tubular caisson to the position above the water surface, cement filling the interior of said central tubular caisson around the exterior of the production string extending therethrough to provide additional support strength to the central tubular caisson, a base including a plurality of legs surrounding the lower end of said caisson and means connecting said legs to said caisson and to each other, and a production platform positioned at the upper end of said central tubular caisson.

6. A caisson structure according to claim 5 wherein said central tubular caisson is steel.

7. A caisson structure according to claim 5 wherein said central tubular caisson is composite material.

8. A caisson structure according to claim 7 wherein said composite material is a filament wound material.

9. A caisson structure according to claim 8 wherein said filament wound material includes suitable fibers wound in a suitable matrix.

10. A caisson structure according to claim 5 wherein said base legs are tubular in shape, and including pilings sized to extend through the interior of said base legs, each of said pilings being tubular in shape for internal cutting to allow retrieval of said caisson structure.

11. The method according to claim 1 including the step of securing a production platform to the upper end of said central tubular caisson.

12. A caisson structure for supporting a platform above water from a subsea location comprising a central tubular caisson having a sufficiently large inner diameter to receive production strings therethrough and being sufficiently long to extend from a subsea location to a position above the water surface, a plurality of production strings extending through said central tubular caisson from said subsea location to a position above the water surface, cement filling the space in said central tubular caisson not occupied by production strings extending therethrough to tie in the exterior of each production string to said central tubular caisson and thus contribute to the stiffness of the central tubular caisson, a base including a plurality of legs parallel to said central tubular caisson and surrounding the lower end of said caisson and means connecting said legs to said caisson and to each other, and a platform positioned at the upper end of said central tubular caisson.

13. A caisson structure according to claim 9 wherein said fiber is a fiberglass fiber.

14. A caisson structure according to claim 9 wherein said fiber is a graphite fiber.

15. A caisson structure according to claim 9 wherein said fiber is a carbon fiber.

* * * * *